US011164500B2

(12) United States Patent
Orio et al.

(10) Patent No.: US 11,164,500 B2
(45) Date of Patent: Nov. 2, 2021

(54) DEVICE AND METHOD FOR COLOR GAMUT ADJUSTMENT

(71) Applicant: SYNAPTICS INCORPORATED, San Jose, CA (US)

(72) Inventors: Masao Orio, Tokyo (JP); Hirobumi Furihata, Tokyo (JP); Akio Sugiyama, Tokyo (JP); Takashi Nose, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 16/697,654

(22) Filed: Nov. 27, 2019

(65) Prior Publication Data

US 2020/0193893 A1 Jun. 18, 2020

(30) Foreign Application Priority Data

Dec. 13, 2018 (JP) ..... JP2018-233870

(51) Int. Cl.
*G09G 3/20* (2006.01)

(52) U.S. Cl.
CPC ... *G09G 3/2003* (2013.01); *G09G 2320/0666* (2013.01); *G09G 2380/02* (2013.01)

(58) Field of Classification Search
CPC ..... G09G 3/2003; G09G 2380/02; G09G 2320/0666; G09G 2320/0285; G09G 2360/144; G09G 2320/043; G09G 2340/06; G09G 2320/0606; G09G 5/02; G09G 3/3607; G09G 5/06
See application file for complete search history.

(56) References Cited

U.S. PATENT DOCUMENTS

| | | | | |
|---|---|---|---|---|
| 10,002,571 | B1 * | 6/2018 | Zulch | G09G 3/34 |
| 2014/0139570 | A1 * | 5/2014 | Albrecht | G09G 5/06 345/694 |
| 2015/0103094 | A1 * | 4/2015 | Xue | G06T 11/001 345/596 |
| 2016/0189670 | A1 * | 6/2016 | Kim | G09G 5/02 345/690 |
| 2017/0142294 | A1 * | 5/2017 | Chen | H04N 1/60 |
| 2018/0342192 | A1 * | 11/2018 | Lee | G06F 1/1652 |
| 2020/0045206 | A1 * | 2/2020 | Yim | G09G 3/2003 |
| 2020/0059573 | A1 * | 2/2020 | Shinohara | G06T 5/001 |

* cited by examiner

*Primary Examiner* — Md Saiful A Siddiqui
(74) *Attorney, Agent, or Firm* — Ferguson Braswell Fraser Kubasta PC

(57) ABSTRACT

A display driver comprises color gamut adjustment circuitry and drive circuitry. The color gamut adjustment circuitry is configured to generate an in-use parameter set based on a plurality of parameter sets corresponding to different color gamuts and a position of a target pixel and generate an output pixel data by performing color gamut adjustment processing on an input pixel data of the target pixel based on the in-use parameter set. The drive circuitry is configured to drive a display panel based on the output pixel data.

16 Claims, 7 Drawing Sheets

DEVICE AND METHOD FOR COLOR GAMUT ADJUSTMENT

CROSS REFERENCE

This application claims priority to Japanese Patent Application No. 2018-233870, filed on Dec. 13, 2018, the disclosure of which is incorporated herein by reference in its entirety.

BACKGROUND

Field

Embodiments disclosed herein generally relate to a device and method for color gamut adjustment of an image displayed on a display panel.

Description of the Related Art

The color gamut assumed in generation of an image data may be different from the color gamut with which a display panel, such as a liquid crystal display (LCD) panel or an organic light emitting diode (OLED) display panel, can display an image. In such case, the image data may be subjected to color gamut adjustment processing to display an image on the display panel with a desired color gamut.

SUMMARY

In one or more embodiments, a display driver comprises color gamut adjustment circuitry and drive circuitry. The color gamut adjustment circuitry is configured to generate an in-use parameter set based on a plurality of parameter sets corresponding to different color gamuts and a position of a target pixel and generate an output pixel data by performing color gamut adjustment processing on an input pixel data of the target pixel based on the in-use parameter set. The drive circuitry is configured to drive a display panel based on the output pixel data.

In one or more embodiments, a host comprises a processor and an interface. The processor is configured to generate an image data corresponding to an image to be displayed on a display panel and a color gamut setting data that defines a region in the image and a color gamut of the region. The interface is configured to transmit the image data and the color gamut setting data to a display driver configured to drive the display panel.

In one or more embodiments, a method comprises generating an in-use parameter set based on a plurality of parameter sets corresponding to different color gamuts and a position of a target pixel and generating an output pixel data by performing color gamut adjustment processing on an input pixel data of the target pixel based on the in-use parameter set. The method further comprises driving a display panel based on the output pixel data.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
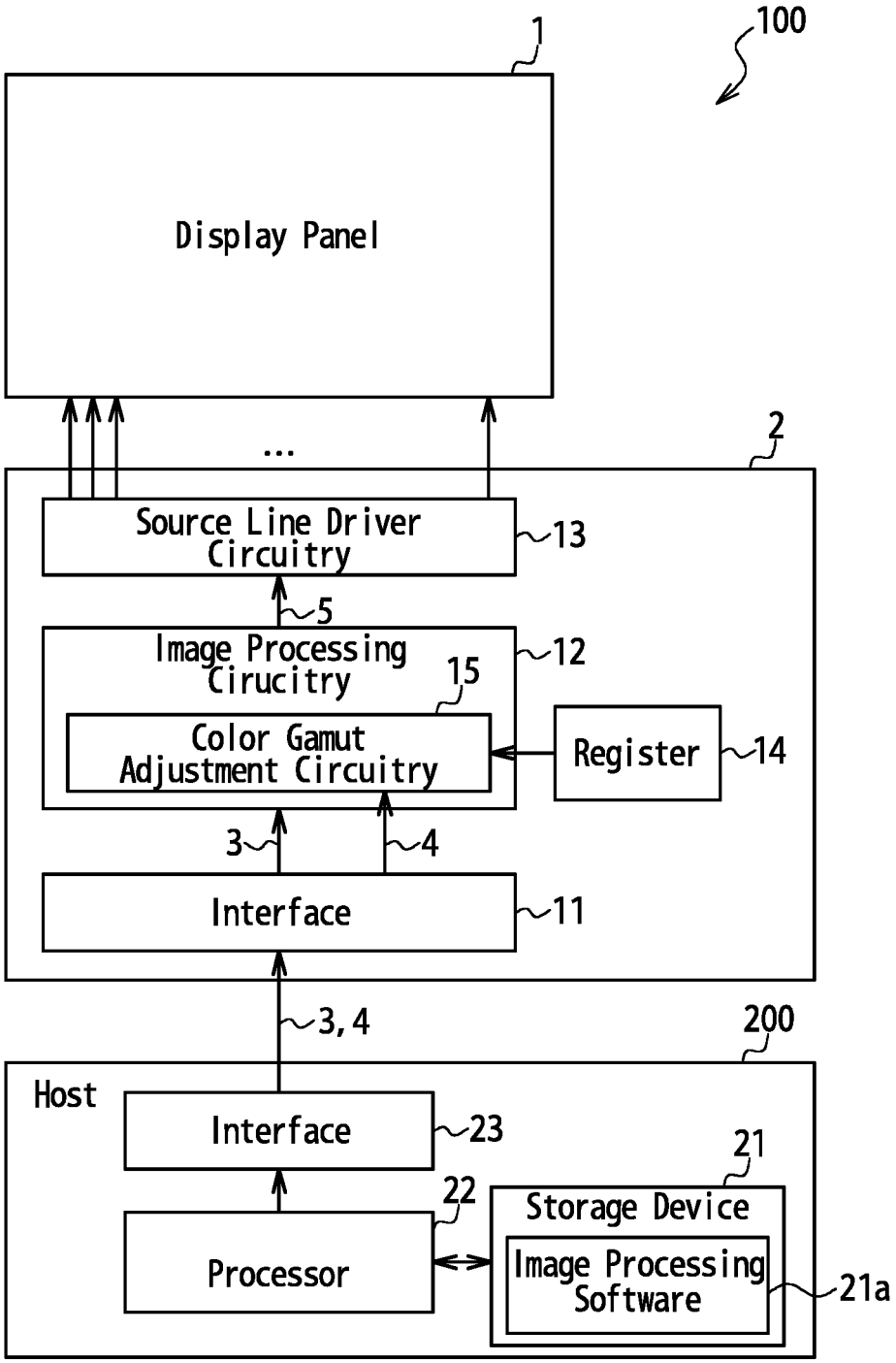
FIG. 1 illustrates an example configuration of a display device, according to one or more embodiments.

To facilitate understanding, identical reference numerals have been used, where possible, to designate identical elements that are common to the figures. Suffixes may be attached to reference numerals to distinguish identical elements from each other. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

In one or more embodiments, as illustrated in FIG. 1, a display device 100 comprises a display panel 1 and a display driver 2. In various embodiments, the display driver 2 is configured to drive the display panel 1 based on an image data 3 received from a host 200 to display an image corresponding to the image data 3 on the display panel 1. The image data 3 may comprise pixel data that describe grayscale values of respective colors of respective pixels of the display panel 1. Alternatively, the image data 3 may comprise data used to generate such pixel data in the display driver 2.

In one or more embodiments, the display driver 2 is further configured to receive a color gamut setting data 4 from the host 200. The color gamut setting data 4 may specify at least one color gamut for an image to be displayed on the display panel 1.

Figure 2:
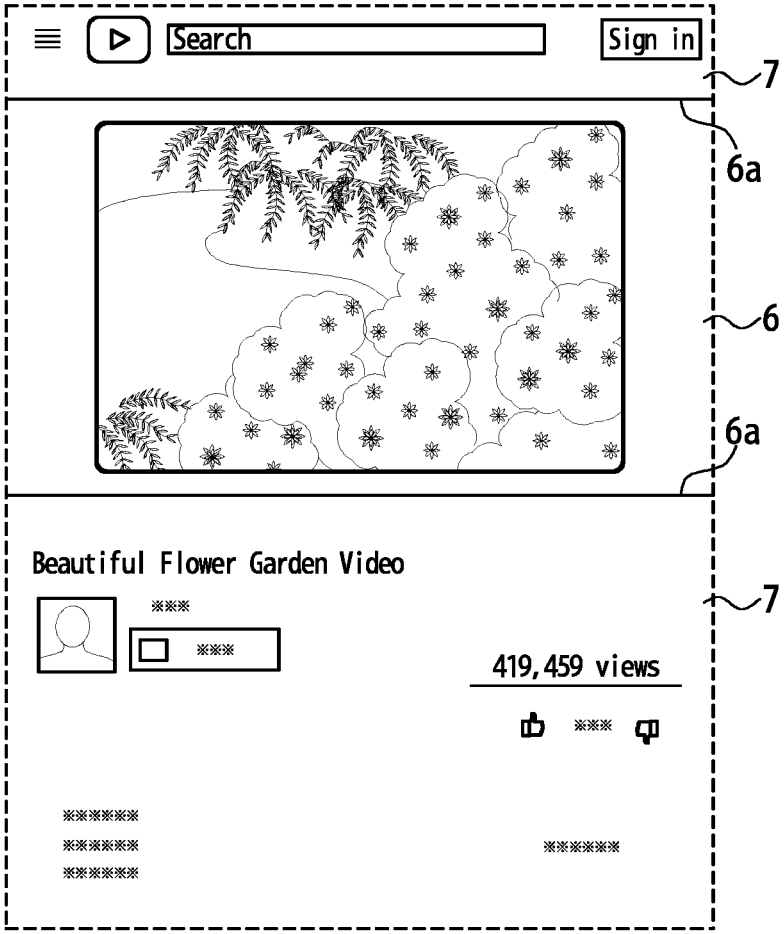
FIG. 2 illustrates an example image displayed on a display panel.

Referring to FIG. 2, the color gamut setting data 4 may define one or more regions 6 in the image displayed on the display panel 1 and further specify color gamuts of the regions 6. In the embodiment Illustrated in FIG. 2, for example, one region 6 is specified. The region 6 may be rectangular and the color gamut setting data 4 may specify the positions of the vertexes of the region 6 and/or the dimensions of the region 6. The color gamut setting data 4 may further specify the color gamut of a background region 7. The background region 7 may be the region of the displayed image other than the region 6. In FIG. 2, the numeral 6*a* denotes the boundary between the region 6 and the background region 7.

Referring back to FIG. 1, in one or more embodiments, the display driver 2 comprises an interface 11, image processing circuitry 12, source line driver circuitry 13, and a register 14. The interface 11 may be configured to receive the image data 3 from the host 200 and forward the image data 3 to the image processing circuitry 12. The image processing circuitry 12 may be configured to perform desired image processing on the image data 3 to generate processed image data 5. The source line driver circuitry 13 may be configured to drive source lines (not illustrated) of the display panel 1 based on the processed image data 5. The register 14 may be configured to hold various control parameters to control the display driver 2. The control parameters may comprise parameters used in the image processing in the image processing circuitry 12. The control parameters to be held in the register 14 may be stored in a non-volatile memory (not illustrated) and forwarded to the register 14 from the non-volatile memory in booting the display device 100.

In one or more embodiments, the host 200 comprises a storage device 21, a processor 22, and an interface 23. The storage device 21 may be used as a non-transitory tangible storage medium configured to store image processing software 21*a*; the image processing software 21*a* may be installed on the storage device 21. The image processing software 21*a* may be provided in the form of a computer program product recorded on a computer-readable recording medium. Alternatively, the image processing software 21*a* may be provided in the form of a computer program product downloadable from a server. The storage device 21 may be used as a work area of the processor 22. In one or more embodiments, the processor 22 is configured to execute the image processing software 21*a* to generate the image data 3 and the color gamut setting data 4 to be supplied to the display driver 2. The interface 23 may be configured to transmit the image data 3 and the color gamut setting data 4 thus generated. The processor 22 may be configured to generate the color gamut setting data 4 for the image displayed in each frame period. In such embodiments, the interface 23 may be configured to transmit the color gamut setting data 4 in a blanking period disposed at the beginning of each frame period and transmit the image data 3 in the blanking period and a display updating period that follows the blanking period.

For the image illustrated in FIG. 2, for example, the processor 22 may generate the color gamut setting data 4 to define the region 6 and also to specify the color gamut of the region 6. The processor 22 may be configured to determine the color gamut to be specified for the region 6 based on contents to be displayed in the region 6. In embodiments where a moving image is displayed in the region 6, for example, the processor 22 may be configured to specify the color gamut required by the AdobeRGB specification for the region 6. The processor 22 may be configured to generate the color gamut setting data 4 to further specify the color gamut of the background region 7. For the image illustrated in FIG. 2, for example, the processor 22 may be configured to generate the color gamut setting data 4 to specify the color gamut of the background region 7 as that required by the sRGB specification. Note that various associations or combinations of regions and color gamuts are possible in the image.

Figure 3:
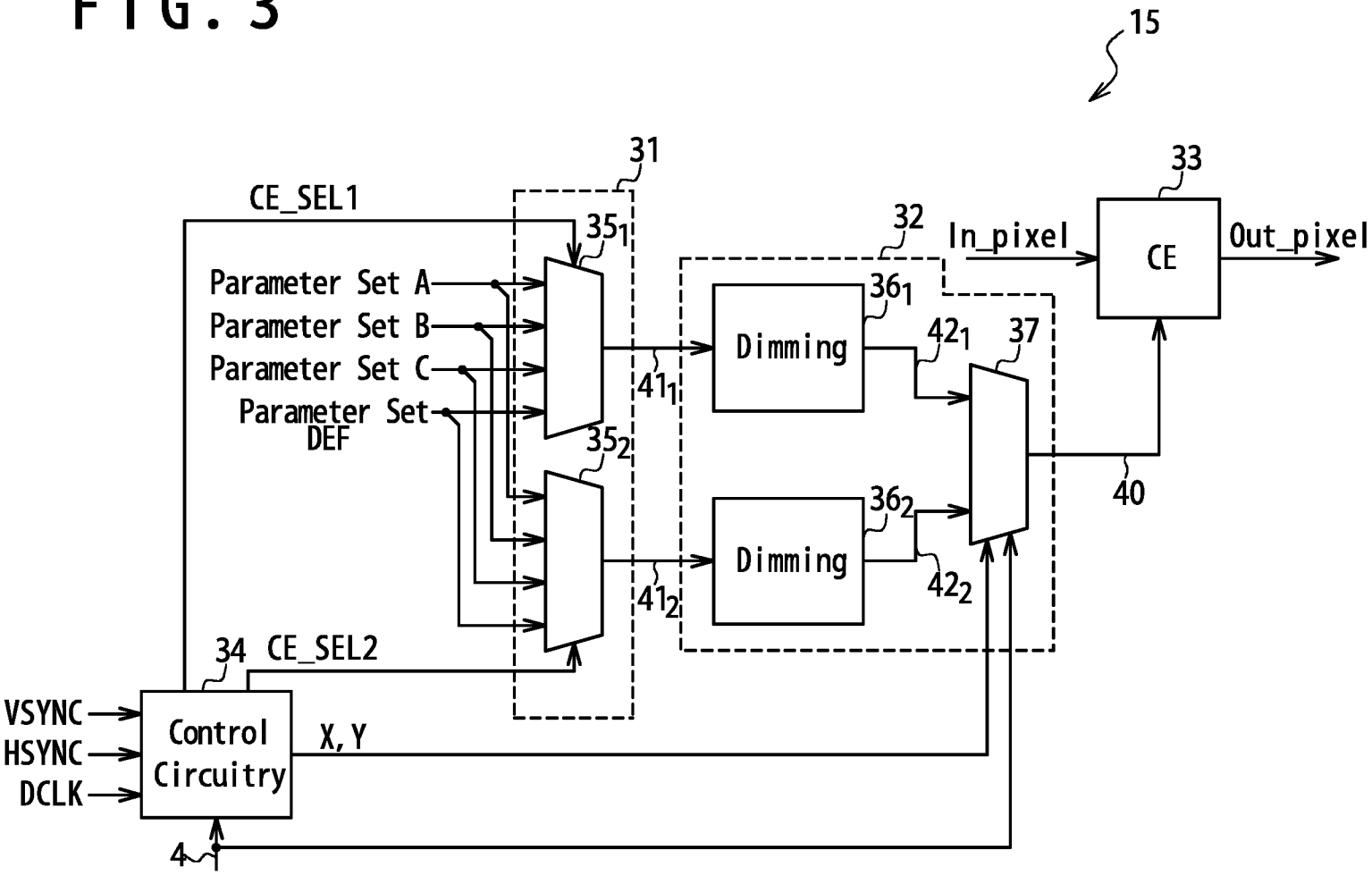
FIG. 3 illustrates an example configuration of color gamut adjustment circuitry, according to one or more embodiments.

Referring back to FIG. 1, in one or more embodiments, the image processing circuitry 12 may comprise color gamut adjustment circuitry 15. As illustrated in FIG. 3, the color gamut adjustment circuitry 15 may be configured to perform color gamut adjustment processing on input pixel data In_pixel to generate output pixel data Out_pixel. The input pixel data In_pixel may correspond to the image data 3 supplied to the image processing circuitry 12. Pixel data contained in the image data 3 may be used as the input pixel data In_pixel without modification. Alternatively, the input pixel data In_pixel may be generated based on the image data 3 in the image processing circuitry 12. The output pixel data Out_pixel may correspond to the processed image data 5 outputted from the image processing circuitry 12. The output pixel data Out_pixel may be used as the processed image data 5 without modification. Alternatively, the processed image data 5 may be generated by performing desired processing on the output pixel data Out_pixel.

In one or more embodiments, the color gamut adjustment circuitry 15 is configured to, for an input pixel data In_pixel associated with a target pixel, perform the color gamut adjustment processing based on the position of the target pixel in the display panel 1. This enables defining regions with different color gamuts in an image displayed on the display panel 1. For the image illustrated in FIG. 2, for example, the color gamut adjustment processing is performed on the input pixel data In_pixel to achieve the color gamut required by the AdobeRGB specification when the target pixel is in the region 6, and the color gamut adjustment processing is performed to achieve the color gamut required by the sRGB specification when the target pixel is in the background region 7.

In one or more embodiments, as illustrated in FIG. 3, a plurality of parameter sets corresponding to different color gamuts are supplied to the color gamut adjustment circuitry 15. Each parameter set may comprise parameters used in the color gamut adjustment processing, and the parameters of each parameter set may be determined to achieve the corresponding color gamut. In the embodiment illustrated in FIG. 3, parameter sets A, B, and C comprise parameters to achieve color gamuts "A", "B", and "C", respectively, through the color gamut adjustment processing. In one or more embodiments, the color gamuts "A", "B", and "C" comprise at least two of the color gamuts required by the sRGB specification, the AdobeRGB specification, and the digital cinema initiatives (DCI)-P3. In such embodiments, the parameter sets A, B, and C may comprise at least two of an sRGB parameter set corresponding to the color gamut required by the sRGB specification, an AdobeRGB parameter set corresponding to the color gamut required by the AdobeRGB specification, and a DCI-P3 parameter set corresponding to the color gamut required by the DCI-P3 specification. In one or more embodiments, a parameter set DEF comprises parameters to achieve a default color gamut. The default color gamut may be an intrinsic color gamut of the display panel 1. The parameter set DEF may be generated so that the input pixel data In_pixel is outputted as the output pixel data Out_pixel without modification.

The parameter sets A, B, C, and DEF may be stored in the register 14 as a part of the control parameters and supplied from the register 14 to the color gamut adjustment circuitry 15. In one or more embodiments, the color gamut adjustment circuitry 15 is configured to determine an in-use parameter set 40 based on the plurality of parameter sets supplied thereto and the position of the target pixel and perform the color gamut adjustment processing on the input pixel data In_pixel associated with the target pixel based on the in-use parameter set 40 thus determined.

In one or more embodiments, the color gamut adjustment circuitry 15 comprises selector circuitry 31, parameter set output circuitry 32, processing circuitry 33, and control circuitry 34.

The selector circuitry 31 may be configured to select a plurality of selected parameter sets 41 from among the parameter sets A, B, C, and DEF supplied to the color gamut adjustment circuitry 15. The selector circuitry 31 may comprise two selectors $\mathbf{35}_1$ and $\mathbf{35}_2$ as illustrated in FIG. 3. The selector $\mathbf{35}_1$ may be configured to select a selected parameter set $\mathbf{41}_1$ from among the parameter sets A, B, C, and DEF based on a select signal CE_SEL1 received from the control circuitry 34, and the selector $\mathbf{35}_2$ may be configured to select a selected parameter set $\mathbf{41}_2$ from among the parameter sets A, B, C, and DEF based on a select signal CE_SEL2 received from the control circuitry 34.

The parameter set output circuitry 32 may be configured to output the in-use parameter set 40 based on the selected parameter sets $\mathbf{41}_1$ and $\mathbf{41}_2$ received from the selector circuitry 31 and coordinates X and Y indicating the position of the target pixel. The parameter set output circuitry 32 may comprise dimming circuitries $\mathbf{36}_1$ and $\mathbf{36}_2$ and a selector 37.

The dimming circuitries $\mathbf{36}_1$ and $\mathbf{36}_2$ may be configured to generate dimmed parameter sets $\mathbf{42}_1$ and $\mathbf{42}_2$ by dimming the selected parameter sets $\mathbf{41}_1$ and $\mathbf{41}_2$, respectively. The dimming may generate an output that follows an input while gradually changing the output when the output is different from the input. In one or more embodiments, when the dimmed parameter set $\mathbf{42}_1$ becomes different from the selected parameter set $\mathbf{41}_1$ as a result of a change in the selected parameter set $\mathbf{41}_1$, the dimming circuitry $\mathbf{36}_1$ may output the dimmed parameter set $\mathbf{42}_1$, gradually modifying the dimmed parameter set $\mathbf{42}_1$ so that the dimmed parameter set $\mathbf{42}_1$ becomes identical to the selected parameter set $\mathbf{41}_1$. Once the dimming makes the dimmed parameter set $\mathbf{42}_1$ identical to the selected parameter set $\mathbf{41}_1$ and the selected parameter set $\mathbf{41}_1$ experiences no change thereafter, the dimming circuitry $\mathbf{36}_1$ may output the selected parameter set $\mathbf{41}_1$ as the dimmed parameter set $\mathbf{42}_1$ without modification. In one or more embodiments, the dimming circuitry $\mathbf{36}_2$ is configured to generate the dimmed parameter set $\mathbf{42}_2$ by dimming the selected parameter set $\mathbf{41}_2$ in a similar manner to the dimming circuitry $\mathbf{36}_1$.

In one or more embodiments, the selector 37 is configured to receive the coordinates (X, Y) indicating the position of the target pixel from the control circuitry 34 and select the in-use parameter set 40 from among the dimmed parameter sets $\mathbf{42}_1$ and $\mathbf{42}_2$ based on the coordinates (X, Y). The selector 37 may be configured to receive the color gamut setting data 4 from the host 200 and select the in-use parameter set 40 from among the dimmed parameter sets $\mathbf{42}_1$ and $\mathbf{42}_2$ based on the coordinates (X, Y) and the color gamut setting data 4.

The selector circuitry 31 may be configured to supply N selected parameter sets 41 to the parameter set output circuitry 32, where N is an integer of three or more. In such embodiments, the parameter set output circuitry 32 may comprise N dimming circuitries 36. The N dimming circuitries 36 may be respectively configured to generate N dimmed parameter sets 42 by dimming the N selected parameter sets 41. The selector 37 may be configured to select the in-use parameter set 40 from among the thus generated N dimmed parameter sets 42 based on the coordinates (X, Y) of the target pixel and the color gamut setting data 4.

In one or more embodiments, the processing circuitry 33 is configured to generate the output pixel data Out_pixel by performing the color gamut adjustment processing on the input pixel data In_pixel based on the in-use parameter set 40 received from the parameter set output circuitry 32. The color gamut adjustment processing performed by the processing circuitry 33 may comprise color enhancement.

In one or more embodiments, the control circuitry 34 is configured to control the operation of the color gamut adjustment circuitry 15. The control circuitry 34 may be configured to generate select signals CE_SEL1 and CE_SEL2 based on the color gamut setting data 4. In embodiments where the color gamut setting data 4 specifies the color gamut "A" for the region 6 of the display panel 1 and the color gamut "B" for the background region 7, the control circuitry 34 generates the select signals CE_SEL1 and CE_SEL2 so that the parameter set A is selected based on the select signal CE_SEL1 and the parameter set B is selected based on the select signal CE_SEL2.

The control circuitry 34 may be further configured to generate the coordinates (X, Y) to indicate the position of the target pixel based on a vertical sync signal VSYNC, a horizontal sync signal HSYNC, and a dot clock DCLK and supply the coordinates (X, Y) to the selector 37.

In embodiments where the image illustrated in FIG. 2 is displayed on the display panel 1, the color gamut adjustment circuitry 15 may operate as follows. In one or more embodiments, the AdobeRGB parameter set is supplied to the color gamut adjustment circuitry 15 as the parameter set A and the sRGB parameter set is supplied to the color gamut adjustment circuitry 15 as the parameter set B. Further, the color gamut setting data 4 may be supplied to the color gamut adjustment circuitry 15 from the host 200. This color gamut setting data 4 may indicate that the color gamut of the region 6 is the color gamut required by the AdobeRGB specification, and the color gamut of the background region 7 is the color gamut required by the sRGB specification.

In one or more embodiments, the control circuitry 34 generates, based on the color gamut setting data 4, the select signal CE_SEL1 to select the parameter set A, which corresponds to the color gamut required by the AdobeRGB specification, and the select signal CE_SEL2 to select the parameter set B, which corresponds to the color gamut required by the sRGB specification. In such embodiments, the selector circuitry 31 may supply the parameter set A to the parameter set output circuitry 32 as the selected parameter set $\mathbf{41}_1$ based on the select signal CE_SEL1 and supply the parameter set B to the parameter set output circuitry 32 as the selected parameter set $\mathbf{41}_2$ based on the select signal CE_SEL2.

In one or more embodiments, the dimming circuitries $\mathbf{36}_1$ and $\mathbf{36}_2$ of the parameter set output circuitry 32 generate the dimmed parameter sets $\mathbf{42}_1$ and $\mathbf{42}_2$, respectively by dimming the selected parameter sets $\mathbf{41}_1$ and $\mathbf{41}_2$, respectively.

The selector 37 may select the in-use parameter set 40 from between the dimmed parameter sets $\mathbf{42}_1$ and $\mathbf{42}_2$ based on the coordinates (X, Y) of the target pixel and the color gamut setting data 4. The selector 37 may select the dimmed parameter sets $\mathbf{42}_1$, which corresponds to the color gamut required by the AdobeRGB specification, as the in-use parameter set 40 when the target pixel is in the region 6. The selector 37 may select the dimmed parameter sets $\mathbf{42}_2$, which corresponds to the color gamut required by the sRGB specification, as the in-use parameter set 40 when the target pixel is in the background region 7. In various embodiments, the in-use parameter set 40 thus selected is supplied to the processing circuitry 33.

In one or more embodiments, the processing circuitry 33 performs color gamut adjustment processing on the input pixel data In_pixel associated with the target pixel based on the in-use parameter set 40 to generate the output pixel data Out_pixel.

The above-described operation may enable an adaptive color gamut adjustment for a plurality of regions defined in the display panel 1. The dimming may enable smoothly changing the color gamut.

Figure 4:
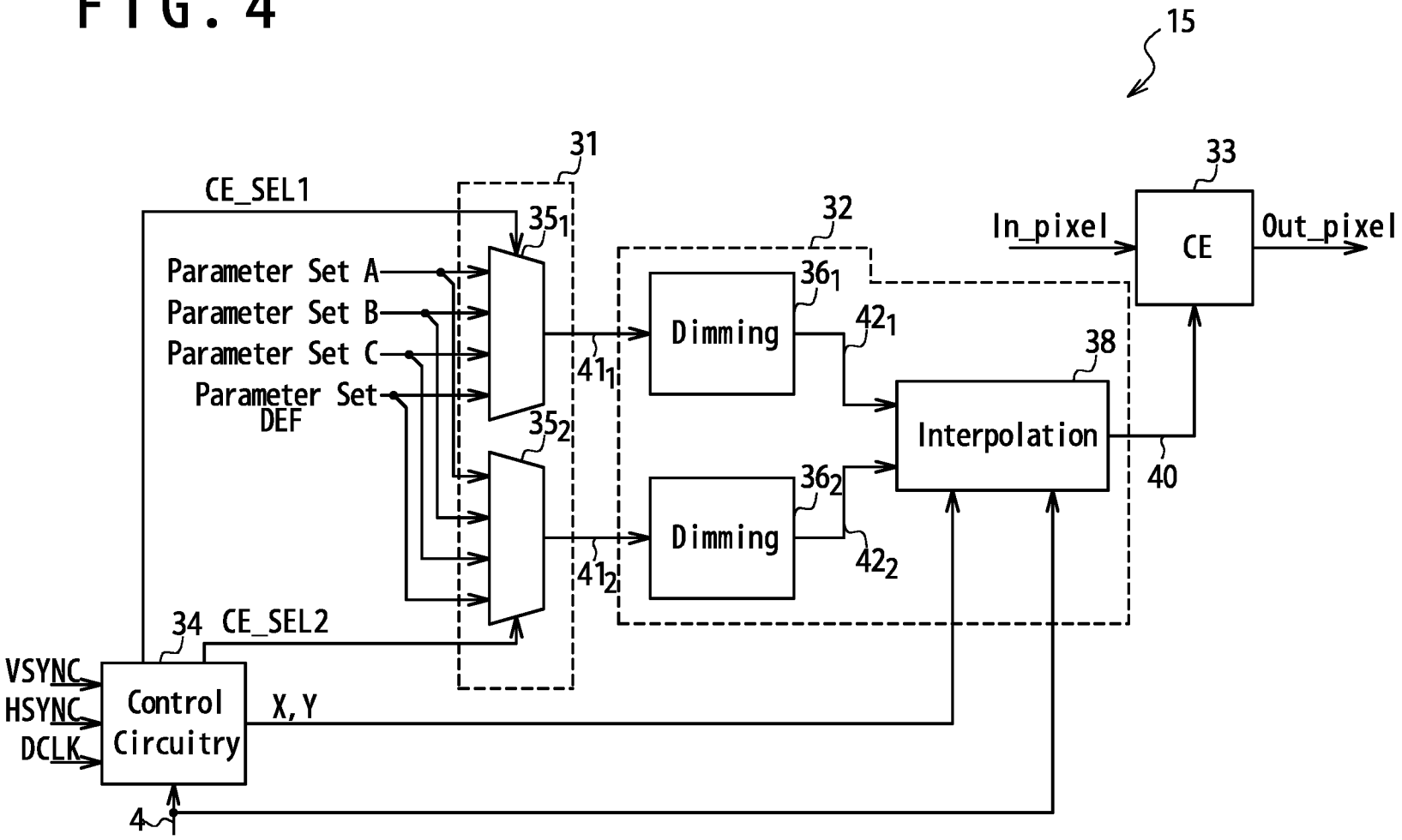
FIG. 4 illustrates an example configuration of color gamut adjustment circuitry, according to one or more embodiments.

In one or more embodiments, as illustrated in FIG. 4, the parameter set output circuitry 32 comprises interpolation circuitry 38 in place of the selector 37. In various embodiments, the interpolation circuitry 38 is configured to generate the in-use parameter set 40 through an interpolation of the dimmed parameter sets $\mathbf{42}_1$ and $\mathbf{42}_2$ based on the color gamut setting data 4 and the coordinates (X, Y) of the target pixel. The interpolation circuitry 38 may be configured to output the dimmed parameter set $\mathbf{42}_1$ as the in-use parameter set 40 without modification when the target pixel is positioned at a first position and output the dimmed parameter set $\mathbf{42}_2$ as the in-use parameter set 40 without modification when the target pixel is positioned at a second position. In such embodiments, the interpolation circuitry 38 may be configured to generate the in-use parameter set 40 through an interpolation of the dimmed parameter sets $\mathbf{42}_1$ and $\mathbf{42}_2$ based on the position of the target pixel when the target pixel is positioned between the first position and the second position.

For the image illustrated in FIG. 2, for example, the select signal CE_CEL1 may be based on the color gamut to be specified for the region 6 and the select signal CE_CEL2 may be based on the color gamut to be specified for the background region 7. The interpolation circuitry 38 may be configured to output or use the dimmed parameter set $\mathbf{42}_1$ as the in-use parameter set 40 without modification, when the target pixel is positioned at a first position which is in the region 6 and apart from the boundary 6*a* between the region 6 and the background region 7. The interpolation circuitry 38 may be further configured to output or use the dimmed parameter set $\mathbf{42}_2$ as the in-use parameter set 40 without modification, when the target pixel is positioned at a second position which is in the background region 7 and apart from the boundary 6*a*. In such embodiments, the interpolation circuitry 38 may be configured to generate the in-use parameter set 40 through an interpolation of the dimmed parameter sets $\mathbf{42}_1$ and $\mathbf{42}_2$ based on the position of the target pixel when the target pixel is positioned near the boundary 6*a* between the region 6 and the background region 7. Such operation may enable smoothly changing the color gamut at the boundary region between regions for which different color gamuts are specified.

Figure 5:
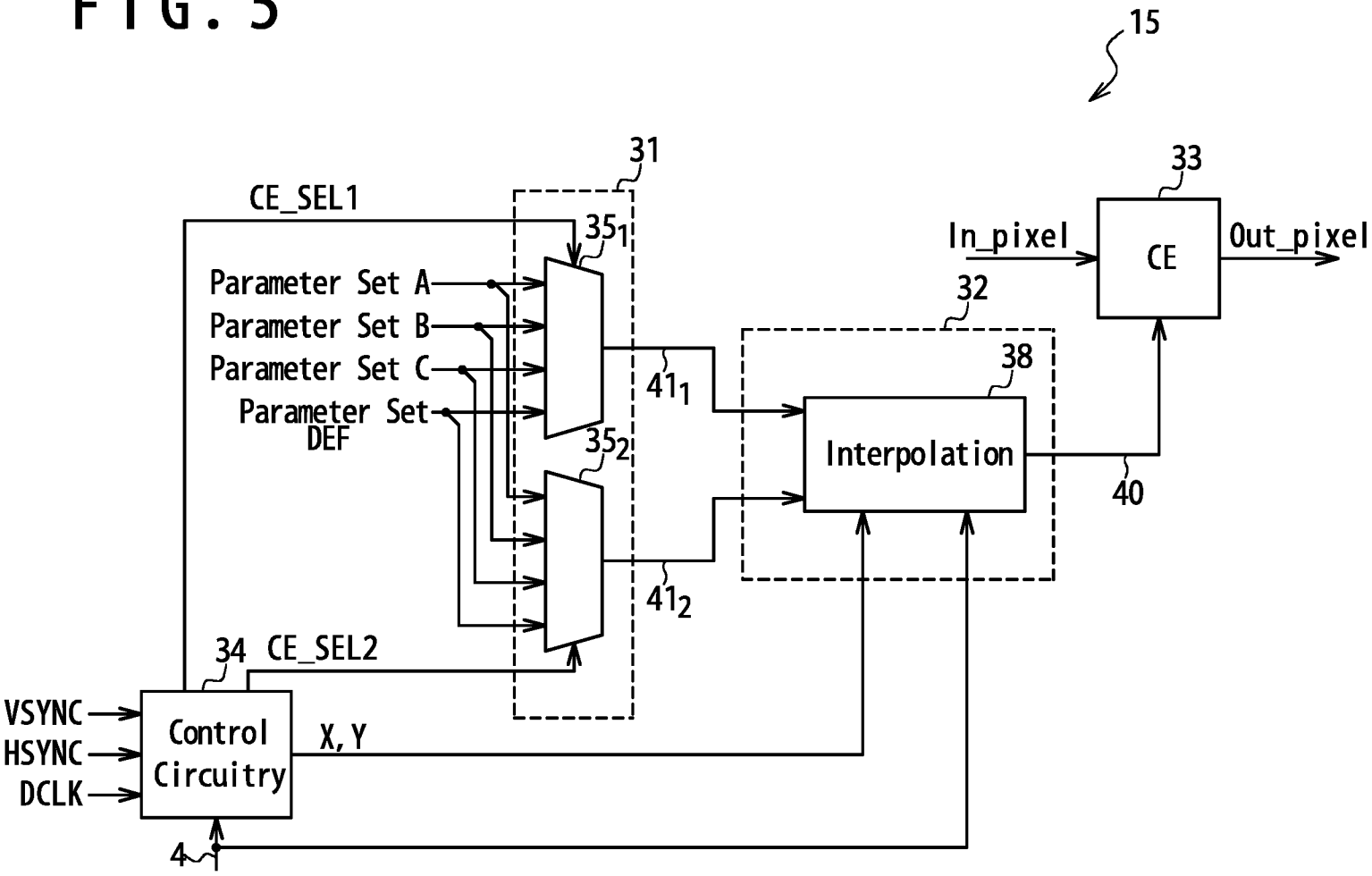
FIG. 5 illustrates an example configuration of color gamut adjustment circuitry, according to one or more embodiments.

In one or more embodiments, as illustrated in FIG. 5, the parameter set output circuitry 32 does not incorporate the dimming circuitries $\mathbf{36}_1$ and $\mathbf{36}_2$. In such embodiments, the interpolation circuitry 38 may be configured to receive the selected parameter sets $\mathbf{41}_1$ and $\mathbf{41}_2$ and generate the in-use parameter set 40 through an interpolation of the selected parameter sets $\mathbf{41}_1$ and $\mathbf{41}_2$ based on the color gamut setting data 4 and the coordinates (X, Y) of the target pixel. The configuration of the color gamut adjustment circuitry 15 illustrated in FIG. 5 may also enable smoothly changing the color gamut at the boundary region between regions for which different color gamuts are specified.

Figure 6:
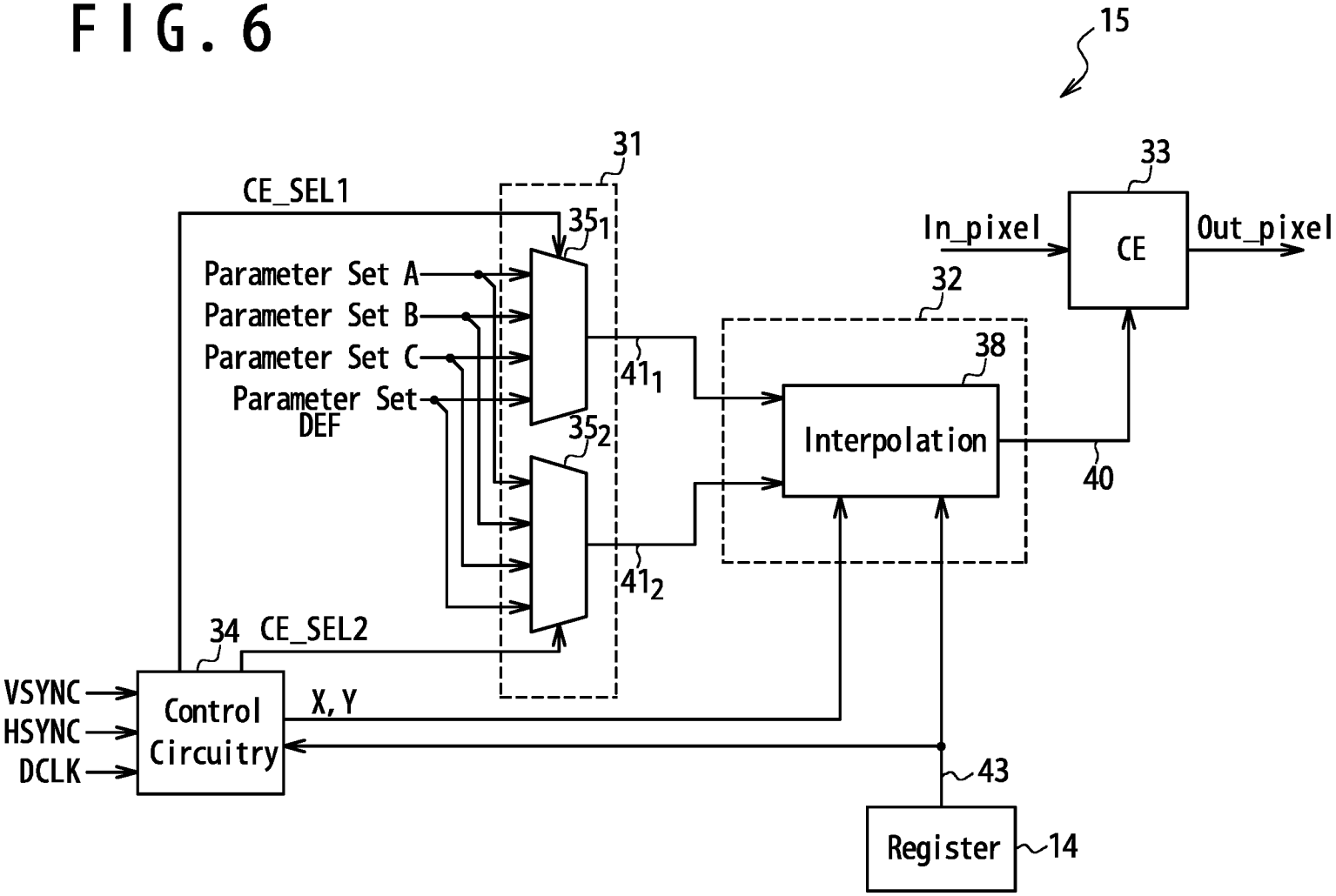
FIG. 6 illustrates an example configuration of color gamut adjustment circuitry, according to one or more embodiments.

In one or more embodiments, as illustrated in FIG. 6, a color gamut setting data 43 is supplied to the interpolation circuitry 38 of the parameter set output circuitry 32 from the register 14 disposed in the display driver 2. The color gamut setting data 43 may define one or more regions in an image displayed on the display panel 1 and further specify color gamuts of the regions. In one or more embodiments, the rest of the color gamut adjustment circuitry 15 may be configured similarly to the configuration illustrated in FIG. 5. The configuration illustrated in FIG. 6 may be used in embodiments where the color gamuts of the regions defined in the image displayed on the display panel 1 are fixed.

Figure 7:
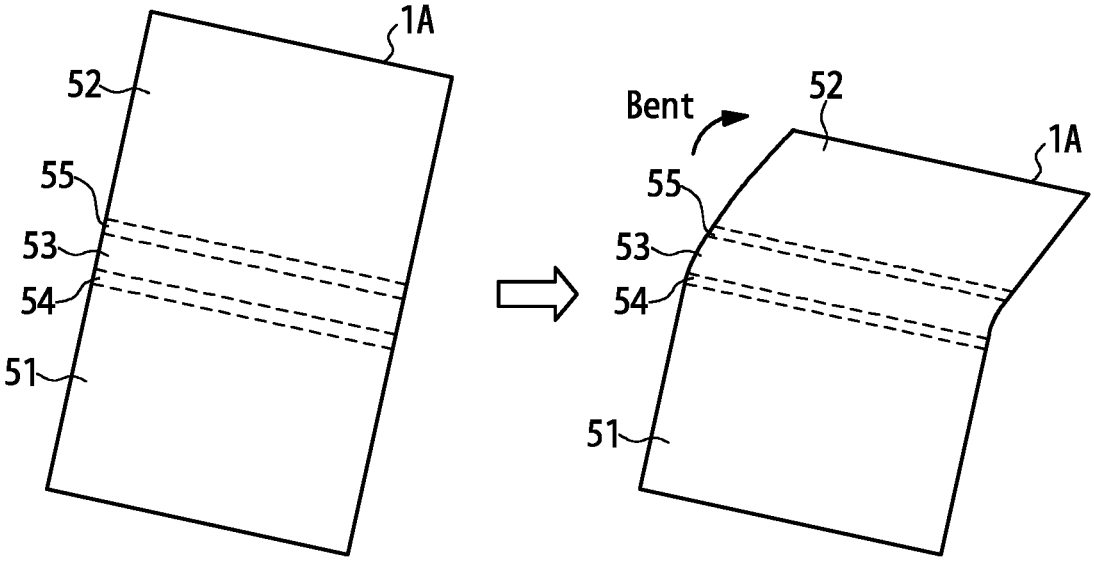
FIG. 7 illustrates an example display panel, according to one or more embodiments.

In one or more embodiments, the color gamut adjustment circuitry 15 configured as illustrated in FIG. 6 is used in the display driver 2 when the display driver 2 is configured to drive a foldable display panel 1A illustrated in FIG. 7. In embodiments illustrated in FIG. 7, flat regions 51, 52 and a foldable region 53 are defined in the foldable display panel 1A. The display panel 1A may be configured to be foldable at the foldable region 53. Some sort of OLED display panels are foldable and such an OLED display panel may be used as the display panel 1A. In one or more embodiments, the position at which the display panel 1A is foldable, that is, the position of the foldable region 53 is fixed.

The color tone of the foldable region 53 may be different from those of the flat regions 51 and 52 depending on characteristics of the display panel 1A. In such embodiments, the color gamut adjustment circuitry 15 may be configured to perform different color gamut adjustments between the flat regions 51, 52 and the foldable region 53 to reduce the difference in the color tone.

In one or more embodiments, a transition region 54 is defined between the flat region 51 and the foldable region 53 and a transition region 55 is defined between the foldable region 53 and the flat region 52. The color gamut may gradually change in the transition regions 54 and 55. In such embodiments, the color gamut setting data 43 may define the flat regions 51, 52, the foldable region 53, and the transition regions 54 and 55 and further specify the color gamuts in the flat regions 51, 52 and the foldable region 53.

In one or more embodiments, the control circuitry 34 is configured to generate, based on the color gamut setting data 43, the select signal CE_SEL1 to select the parameter set corresponding to the color gamut specified for the foldable region 53 and the select signal CE_SEL2 to select the parameter set corresponding to the color gamut specified for the flat regions 51 and 52. The selector circuitry 31 may be configured to select the selected parameter sets $\mathbf{41}_1$ and $\mathbf{41}_2$ from among the parameter sets A, B, C and DEF based on the select signals CE_SEL1 and CE_SEL2, respectively.

In one or more embodiments, the interpolation circuitry 38 is configured to generate the in-use parameter set 40 through an interpolation of the selected parameter sets $\mathbf{41}_1$ and $\mathbf{41}_2$ based on the color gamut setting data 43 and the coordinates (X, Y) of the target pixel. The interpolation circuitry 38 may be configured to output the selected parameter set $\mathbf{41}_1$ as the in-use parameter set 40 without modification when the target pixel is positioned in the foldable region 53 and output the selected parameter set $\mathbf{41}_2$ as the in-use parameter set 40 without modification when the target pixel is positioned in the flat region 51 or 52. The interpolation circuitry 38 may be configured to generate the in-use parameter set 40 through an interpolation of the selected parameter sets $\mathbf{41}_1$ and $\mathbf{41}_2$ based on the coordinate (X, Y) of the target pixel when the target pixel is in the transition region 54 or 55.

This process may mitigate the difference in the color tone between the foldable region 53 and the flat regions 51 and 52 to smoothly couple the images displayed in the flat regions 51 and 52 to the image displayed in the foldable region 53 due to gradual color gamut changes in the transition regions 54 and 55.

While various embodiments have been specifically described herein, a person skilled in the art would appreciate that the technologies disclosed herein may be implemented with various modifications.

What is claimed is:

1. A display driver comprising:

color gamut adjustment circuitry configured to:

select a first selected parameter set from a plurality of parameter sets corresponding to different color gamuts based on a first select signal, the first selected parameter set comprising a first color gamut configuration, wherein the first select signal is for a first region in an image displayed on a display panel;

select a second selected parameter set from the plurality of parameter sets based on a second select signal, the second selected parameter set comprising a second color gamut configuration, wherein the second select signal is for a second region in the image displayed on the display panel;

determine, after selecting the first selected parameter set and the second parameter set, that a first target pixel is in the first region and a second target pixel is in the second region;

generate a first in-use parameter set from the first selected parameter set, based on coordinates of the first target pixel being in the first region;

generate a second in-use parameter set from the second selected parameter set, based on coordinates of the second target pixel being in the second region;

generate output pixel data by performing color gamut adjustment processing on input pixel data of the first target pixel based on the first in-use parameter set and of the second target pixel based on the second in-use parameter set; and drive circuitry configured to drive the display panel based on the output pixel data.

2. The display driver of claim 1, wherein the color gamut adjustment circuitry is further configured to:

generate a first dimmed parameter set by dimming the first selected parameter set;

generate a second dimmed parameter set by dimming the second selected parameter set; and wherein generating the first in-use parameter set from the first selected parameter set comprises using the first dimmed parameter set as the first in-use parameter set; and wherein generating the second in-use parameter set from the second selected parameter set comprises using the second dimmed parameter set as the second in-use parameter set.

3. The display driver of claim 2, wherein generating the first in-use parameter set further comprises interpolating between the first dimmed parameter set and the second dimmed parameter set, based on a position of the first target pixel.

4. The display driver of claim 1, wherein the color gamut adjustment circuitry is further configured to select the first in-use parameter set based on a color gamut setting data that defines the first region in the image and that specifies the first color gamut configuration for the first region.

5. The display driver of claim 4, wherein the color gamut setting data is supplied from a host configured to supply an image data corresponding to the input pixel data.

6. The display driver according to claim 1, wherein the color gamut adjustment circuitry is further configured to generate the first in-use parameter set through an interpolation of the first selected parameter set and the second selected parameter set based on a position of the first target pixel.

7. The display driver of claim 6, wherein the color gamut adjustment circuitry is further configured to generate the first in-use parameter set through an interpolation of the first selected parameter set and the second selected parameter set based on the position of the first target pixel and a color gamut setting data that defines at least the first region in the image and that specifies at least the first color gamut configuration for at least the first region.

8. The display driver of claim 7, wherein the color gamut adjustment circuitry is further configured to:

use the first selected parameter set as the first in-use parameter set for the first target pixel;

use the second selected parameter set as the second in-use parameter set for the second target pixel; and generate a third in-use parameter set through an interpolation of the first selected parameter set and the second selected parameter set when a third target pixel is in a third region of the display panel, the third region being positioned between the first region and the second region.

9. The display driver of claim 1, wherein the first region comprises a foldable region at which the display panel is foldable.

10. A system comprising:

a host comprising:

a processor configured to generate an image data corresponding to an image to be displayed on a display panel and a color gamut setting data that:

defines a first region in the image and a first color gamut configuration specific to the first region, and defines a second region in the image and a second color gamut configuration specific to the second region;

a color gamut adjustment circuitry configured to:

select a first selected parameter set from a plurality of parameter sets corresponding to different color gamuts based on a first select signal, the first selected parameter set comprising the first color gamut configuration, wherein the first select signal is for the first region in the image;

select a second selected parameter set from the plurality of parameter sets based on a second select signal, the second selected parameter comprising the second color gamut configuration, wherein the second selected signal is for the second region in the image;

determine, after selecting the first selected parameter set and the second parameter set, that a first target pixel is in the first region and a second target pixel is in the second region;

generate a first in-use parameter set from the first selected parameter set, based on coordinates of the first target pixel being in the first region;

generate a second in-use parameter set from the second selected parameter set, based on coordinates of the second target pixel being in the second region;

generate output pixel data by performing color gamut adjustment processing on input pixel data of the first target pixel based on the first in-use parameter set and of the second target pixel based on the second in-use parameter set; and drive circuitry configured to drive a display panel based on the output pixel data; and the display panel.

11. The system according to claim 10, wherein the processor is configured to generate the color gamut setting data to specify the first color gamut configuration based on a content to be displayed in the first region.

12. The system according to claim 11, wherein the processor is configured to generate the color gamut setting data to further specify a color gamut configuration of a background region of the image.

13. A method comprising:

selecting a first selected parameter set from a plurality of parameter sets corresponding to different color gamuts based on a first select signal, the first selected parameter set comprising a first color gamut configuration, wherein the first select signal is for a first region in an image displayed on a display panel;

selecting a second selected parameter set from the plurality of parameter sets based on a second select signal, the second selected parameter set comprising a second color gamut configuration, wherein the second select signal is for a second region in the image displayed on the display panel;

determining, after selecting the first selected parameter set and the second parameter set, that a first target pixel is in the first region and a second target pixel is in the second region;

generating a first in-use parameter set from the first selected parameter set, based on coordinates of the first target pixel being in the first region;

generating a second in-use parameter set from the second selected parameter set, based on coordinates of the second target pixel being in the second region;

generating output pixel data by performing color gamut adjustment processing on input pixel data of the first target pixel based on the first in-use parameter set and of the second target pixel based on the second in-use parameter set; and driving the display panel based on the output pixel data.

14. The method of claim 13, further comprising:

generating a first dimmed parameter set by dimming the first selected parameter set;

generating a second dimmed parameter set by dimming the second selected parameter set; and wherein generating the first in-use parameter set from the first selected parameter set further comprises using the first dimmed parameter set as the first in-use parameter set; and wherein generating the second in-use parameter set from the second selected parameter set further comprises using the second dimmed parameter set as the second in-use parameter set.

15. The method of claim 14, wherein generating the first in-use parameter set further comprises:

selecting the first in-use parameter set based on a position of the first target pixel and a color gamut setting data that defines the first region in the image and that specifies the first color gamut configuration for the first region.

16. The method of claim 13, wherein generating the first in-use parameter set further comprises:

generating the first in-use parameter set through an interpolation of the plurality of first selected parameter set and the second selected parameter set based on the position of the first target pixel.

* * * * *